US005109559A

United States Patent [19]

West

[11] Patent Number: 5,109,559

[45] Date of Patent: May 5, 1992

[54] FLOTATION MATTRESS PAD HAVING A COVER WITH PAD RETAINING STRAPS

[76] Inventor: Gordon W. West, 35 Peel Village Parkway, Brampton, Ontario, L6W 1G1, Canada

[21] Appl. No.: 643,531

[22] Filed: Jan. 18, 1991

[51] Int. Cl.[5] ..... A47C 27/10; A47C 31/00

[52] U.S. Cl. ..... 5/451; 5/470; 5/502; 5/903

[58] Field of Search ..... 5/451, 450, 449, 502, 5/500, 455, 470

[56] References Cited

U.S. PATENT DOCUMENTS

| | | | |
|---|---|---|---|
| 2,201,424 | 5/1940 | Berger | 5/451 |
| 3,702,484 | 11/1972 | Tobinick et al. | 5/451 |
| 4,149,286 | 4/1979 | Fogel | 5/451 |
| 4,292,701 | 10/1981 | Woychick | 5/470 |
| 4,549,323 | 10/1985 | Brockhaus | 5/451 |
| 4,597,120 | 7/1986 | Fogel et al. | 5/451 |
| 4,847,931 | 7/1989 | Bard | 5/451 |
| 4,972,534 | 1/1990 | Hutton | 5/451 |
| 4,980,939 | 1/1991 | Smith | 5/451 |
| 5,001,792 | 3/1991 | Strobel | 5/449 |

*Primary Examiner*—Alexander Grosz
*Attorney, Agent, or Firm*—Krass & Young

[57] ABSTRACT

A relatively shallow mattress for a bed which has three integral parts: an inner bladder, an outer bladder and a mattress cover. The inner bladder is formed from a rectangular top and bottom side welded together along the edges. The top side contains a valve. The outer bladder is effectively a safety cover for the inner bladder. It surrounds the inner bladder and but for a circular opening which allows access to the valve on the top side of the inner bladder, it is fluid tight. It is made in a similar fashion to the inner bladder which it permanently encloses. The mattress cover has an upper surface made of a quilted ticking. This ticking incorporates a thermal barrier layer. The mattress cover has a bottom and sides made from a relatively light woven cloth fabric. The mattress cover totally surrounds the bladder. An elongate zipper along the edge of the top surface allows insertion of the bladders and access to the valve used for filling.

13 Claims, 3 Drawing Sheets

FLOTATION MATTRESS PAD HAVING A COVER WITH PAD RETAINING STRAPS

BACKGROUND OF THE INVENTION

This invention relates to waterbeds, and in particular to waterbed mattresses.

Waterbeds in the past have usually been made with a mattress consisting of a large, watertight bladder covered by mattress ticking, and a heavy supporting structure or frame to maintain the shape of the mattress and support the heavy weight of the water filling the bladder. A difficulty with this type of waterbed is that it cannot be moved without draining the mattress, and in view of the large quantity of water, this is time-consuming and wasteful since the water is usually not reused. A further difficulty with these waterbeds is that a leak in the bladder can cause extensive damage.

Attempts have been made to overcome the weight problem. One example of this is shown in U.S. Pat. No. 3,689,949 issued to J. D. Weinstein. Weinstein suggested the use of a base for the water bladder which was hollowed out on its top side in a shape to conform to the general shape of the human body. It was suggested that this structure would effectively reduce the weight of the water above those areas of the mattress which supported the least weight. However, this mattress was unusually bulky.

Another attempt to overcome the weight problem of conventional waterbeds is shown in U.S. Pat. No. 3,789,442 issued to S. Tobinick. This patent shows a hollowed out foamed flexible material which receives a liquid filled bladder. This bladder is also covered by a foamed flexible material. It would seem that the benefits achieved would be accompanied by a lost flotation effect.

A problem with both the Weinstein and Tobinick approaches is that these beds are very expensive to manufacture.

In order to solve the problem of leaking bladders, it has been proposed to make a separate watertight cover or envelope to enclose the main mattress bladder, so that if a leak occurs in the bladder, the water will be contained by the outer watertight cover. A problem with this solution, however, is that it must be possible to open the outer cover to insert the bladder, to fill it, and to empty it. This requires a large watertight closure which itself is prone to leakage.

It is an object of the present invention to provide a lightweight easily transportable flotation pad having a double wall to protect against leaks and which can be used to convert any ordinary bed into a waterbed.

SUMMARY OF THE INVENTION

According to one aspect of the invention there is provided a flotation mattress pad for a bed comprising a rectangular inner bladder constructed from an impervious plastic material having a top side and bottom side with coterminous peripheral edges which are heat sealed to each other in order to form a fluid-tight enclosure. The top side has a valve. A rectangular outer bladder is constructed from a fluid impervious plastic material having a top side and a bottom side with coterminous peripheral edges heat sealed to each other in order to form a fluid-tight enclosure which encloses the inner bladder. The top side of the outer bladder has a circular opening which is positioned to surround the valve on the inner bladder and allow access thereto.

According to another aspect of the invention, there is provided a mattress cover for a flotation mattress pad. The cover comprises an upper side which is constructed of mattress ticking having a thermal barrier layer, and a bottom side and peripheral sides, both made of a woven cloth fiber. The cover is provided with an elongate zippered opening in order to allow the insertion of outer and inner bladders and the filling thereof.

DETAILED DESCRIPTION OF THE DRAWINGS

Figure 1:
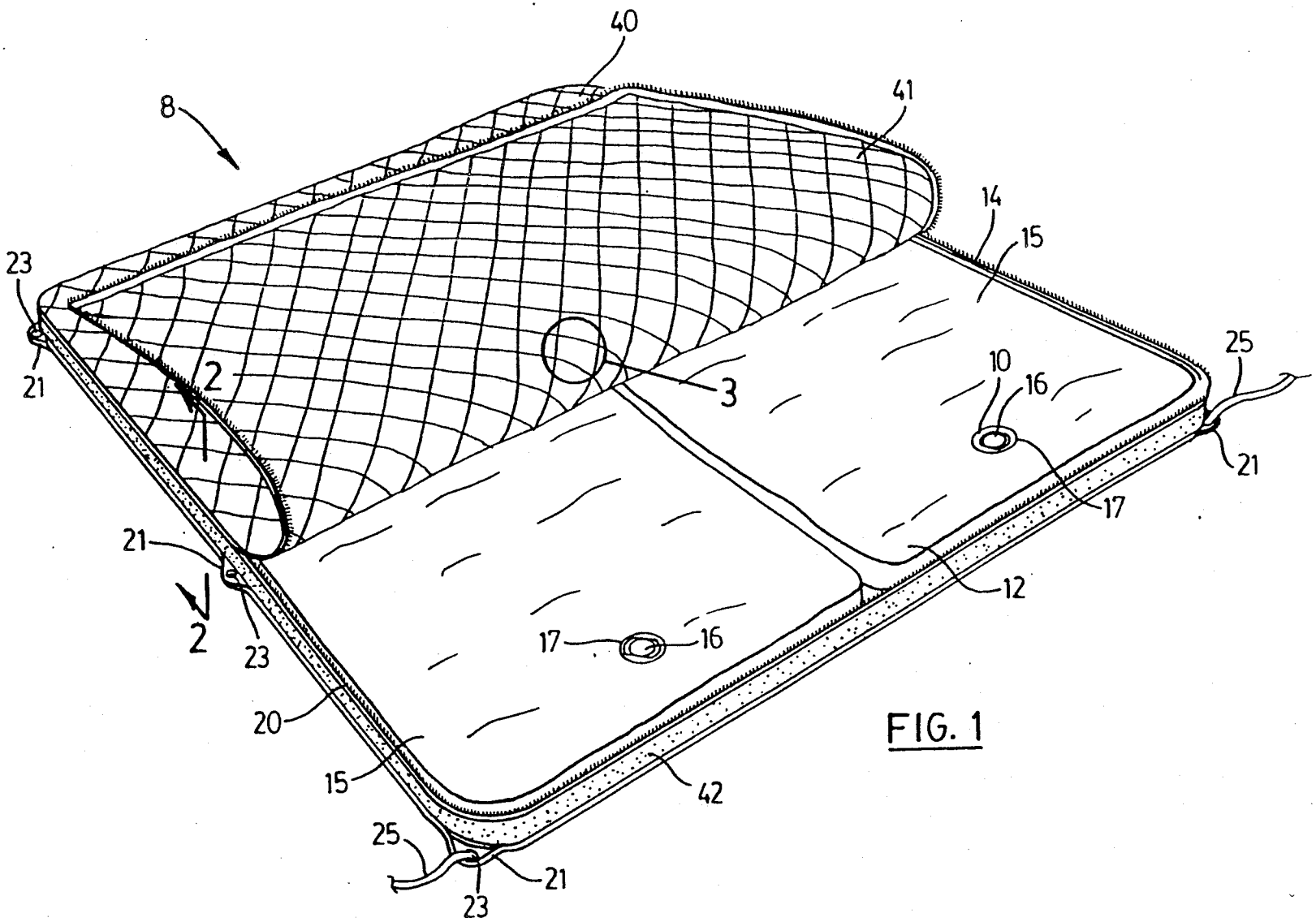
FIG. 1 is perspective view of a flotation mattress pad having two inner bladders.

A flotation mattress pad 8 is shown in an open position in FIG. 1. A zipper 20 is used to removably affix a top of a mattress cover 14 to a side of the mattress cover 14. Disposed within the mattress cover 14 are two double bladder assemblies 15, each bladder assembly 15 including an outer bladder 12 which surrounds an inner bladder 10 which contains a valve 16 therein, which valve is used to fill the inner bladder 10 with a fluid such as water. The flotation mattress pad in FIG. 1 is for a wider bed, such as a standard size double mattress bed, a queen size mattress bed or a king size mattress bed, and appropriately contains two half-width, full length bladder assemblies 15. Alternatively, rather than using the two half-width outer bladders, a single full width outer bladder may be employed (not shown). In such employment, the bladder would have two circular openings in its top side positioned to permit access to the valve 16 in each inner bladder 10. Utilization of two half-width inner bladders 10 and outer bladders 12 reduces the transmission of waves caused by one user of the flotation mattress pad 8 to a second user laying beside the first. The mattress pad 8 is preferably about 5 centimeters (2 inches) thick; however, it may be as thin as 2.5 centimeters (1 inch) or as thick as 10 centimeters (4 inches).

Figure 2:
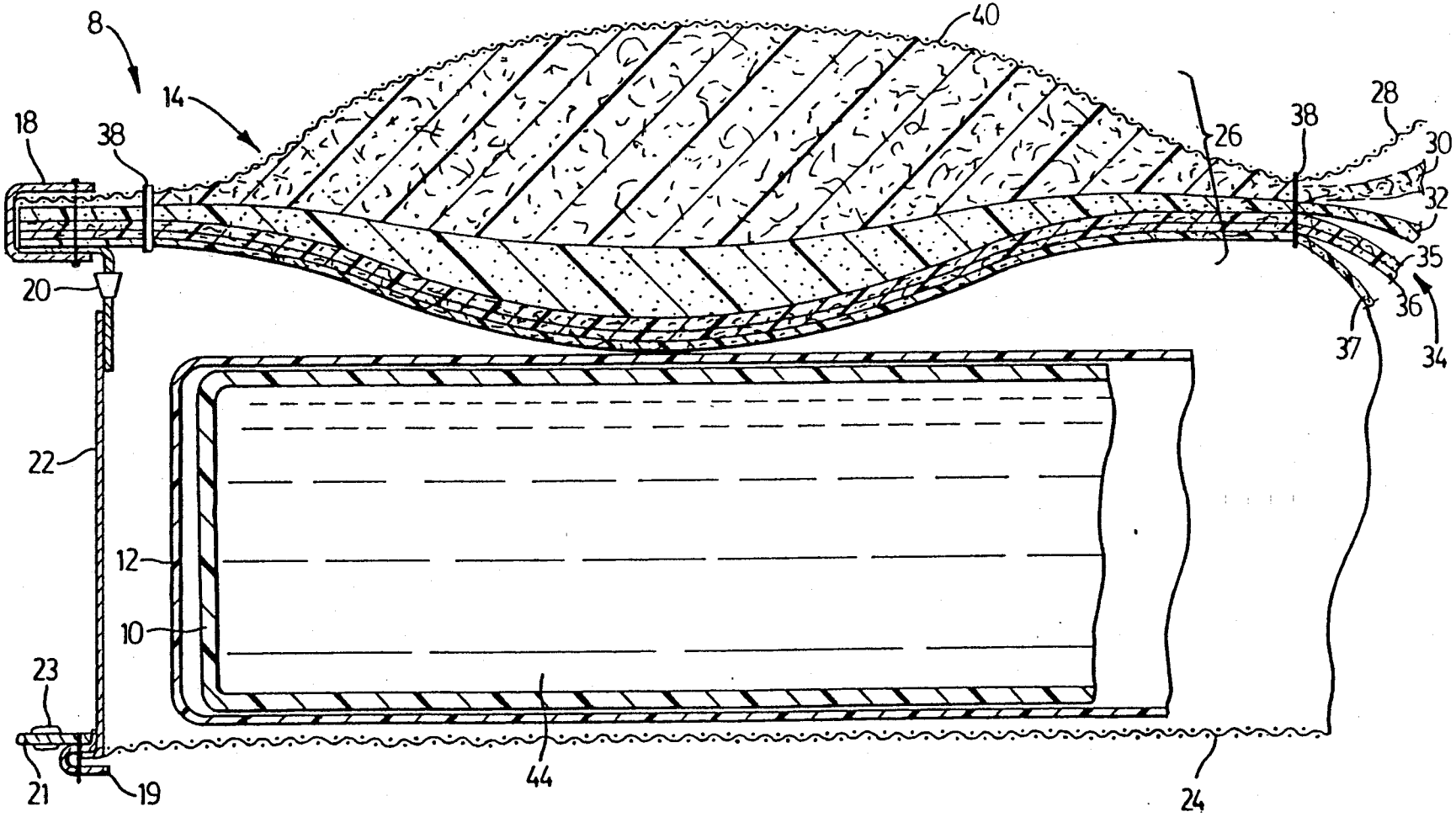
FIG. 2 is an enlarged sectional view of the flotation mattress pad taken along lines 2—2 of FIG. 1.

FIG. 2 is a sectional view of the flotation mattress pad 8 taken along lines 2—2 of FIG. 1. The mattress cover 14 surrounds the outer bladder 12 which itself surrounds the inner bladder 10 which holds the fluid 44 therein. The outer bladder 12 may be made of a thinner material than the inner bladder 10. For example the outer bladder could be made of 10 mil vinyl and the inner bladder made of 20 mil vinyl. Further, it is also useful when filling, in order to ascertain that the inner bladder 10 is correctly aligned with respect to the outer bladder 10, to have the inner bladder 10 made of a coloured material, and the outer bladder 12 made of a transparent material.

The upper side 40 of the mattress cover 14 is composed of a mattress ticking 26 which is peripherally edged by a hem 18 which binds the outside edges of the layers of the mattress ticking 26 to each other as well as securing one side of the zipper 20 to the mattress ticking 26. The mattress ticking 26 itself is composed of a top polyester woven cloth 28, which is above a polyester filling 30, which is above a polyurethane foam layer 32, which is above a thermal barrier 34, which is above a bottom polyester cloth 37, all of which are quilted together. The thermal barrier layer 34 consists of a thin plastic film 35, reflective on both sides, which is attached to one side of a felted sheet 36. The other side of the zipper 20 is secured to an upper edge of a side surface 22 of the mattress cover 14. An additional hem 19 secures a lower edge of the side surface 22 of the mattress cover 14 to the bottom 24 of the mattress cover 14.

As an alternative to the construction of cover 14, the upper side 40 could be made out of lambswool or conventional mattress ticking. Also, cover 14 could be made reversible, with upper side 40 having lambswool on one side and normal mattress ticking on the other side. With a full zipper 20 around the periphery of cover 14, mattress cover 14 could be turned inside out to make the upper surface either lambswool or mattress ticking.

Optional attaching devices, such as flaps 21 may be provided at the corners and along the sides of cover 14. Flaps 21 are provided with grommets 23 for attaching light rope or straps 25 to mattress pad 8 for tying down the mattress pad where it is used in a mobile location such as in a truck, a recreation vehicle or a boat. Alternatively, straps 25 could be attached directly to cover 14 or to flaps 21 by being sewn in place, and such straps could be provided with hook and loop type releasable fasteners on the ends of the straps so that they could surround an anchoring device or even another conventional mattress located under mattress pad 8

Individual users who are prone to arthritis or simply those who prefer a pre-warmed bed may choose to utilize a conventional water bed heater in conjunction with the flotation mattress pad 8. The heater would normally be located between bottom 24 and outer bladder 12. , In order to better facilitate the utilization of fitted bed sheets in standard sizes the flotation mattress pad may be marginally shortened and narrowed in order to provide a space between the peripheral edges of the bed mattress and the peripheral edges of the mattress pad when viewed in plan.

Figure 3:
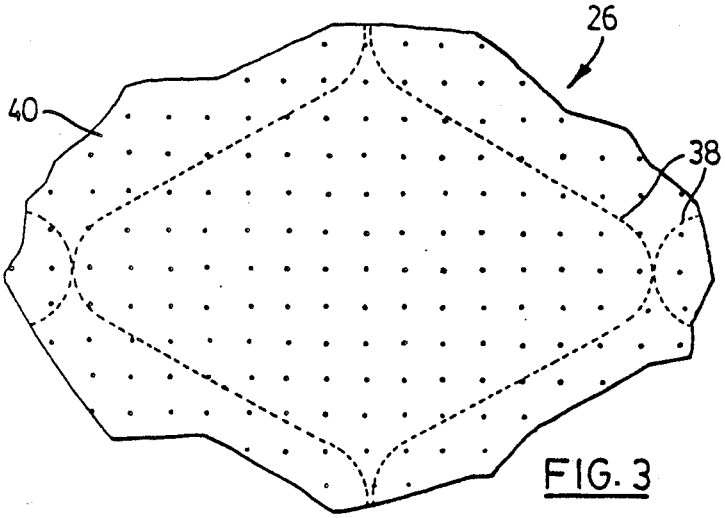
FIG. 3 is a plan view of a portion of the mattress pad indicated in FIG. 1 by circle 3 showing the quilting design thereon.

FIG. 3 is an enlarged plan view of the mattress ticking 26 showing the top side 40 of the mattress cover 14, having a decorative quilting stitching 38 which holds all the layers together.

Figure 4:
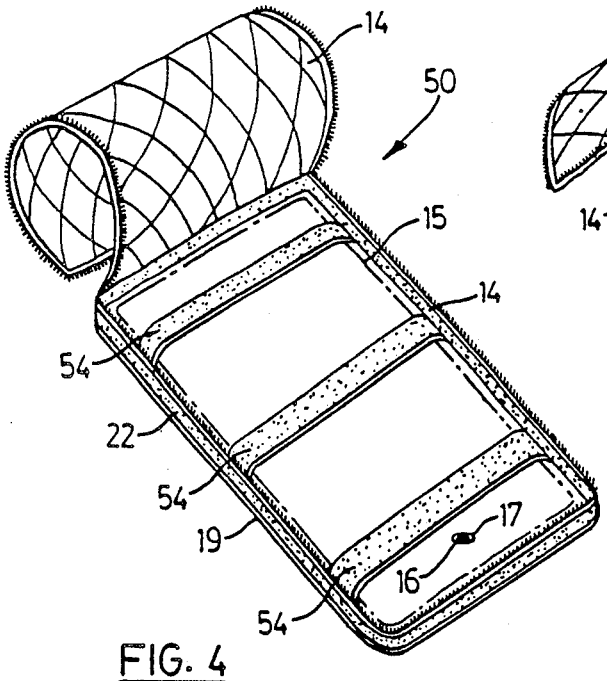
FIG. 4 is a perspective view similar to FIG. 1 but showing a mattress pad with a single inner bladder with retaining straps.
Figure 5:
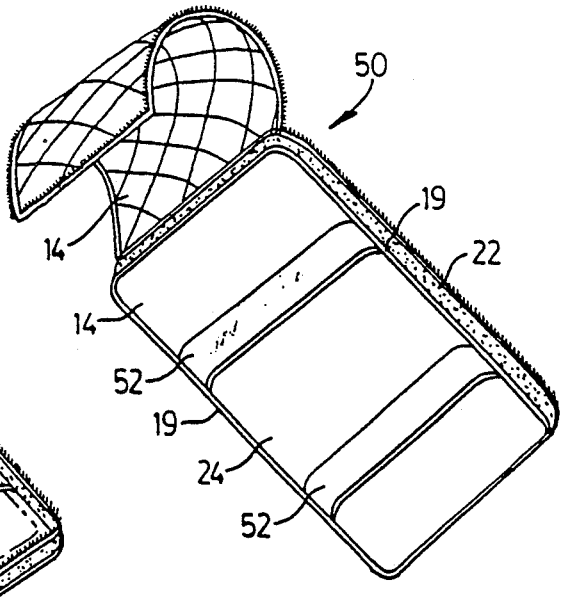
FIG. 5 is a perspective view of the underside of the mattress pad of FIG. 1.

Referring next to FIGS. 4 and 5, a mattress pad 50 is shown which would be suitable for each one of a set of twin beds, or a single bed. A single bladder assembly 15 shown in chain dotted lines in FIG. 4 would be used inside an appropriately sized cover 14. A flotation mattress pad for a single bed is sufficiently light that a child might be able to pull it off the bed. For this reason the mattress cover may be provided with two outer safety straps 52 attached to the underside or bottom 24 of cover 14. One strap would encircle each end of a conventional bed mattress to secure mattress pad 50 in place. The two safety straps are about 7.5 centimeters (3 inches) wide, are formed of elasticized fabric, and are sewn between opposed bottom hems 19 of mattress cover 14. In addition, inside mattress cover 14, as seen in FIG. 4, three non-stretch inner straps 54 span from opposite bottom side hems 19 of mattress cover 14, across the top of the bladder assembly 15 to hold bladder assembly 15 inside mattress cover 14. Straps 54 are about 7 to 10 centimeters in Width and are made of the same material as side surfaces 22, which is a felted synthetic material flame treated to increase tear strength, but yet remain breathable. However, straps 54 could be made of any suitable webbing or elasticized material, if desired. Straps 52, 54 are optional, and usually are not required at all on the larger mattress pads containing two bladder assemblies 15. However, straps 52, 54 could be employed in the embodiments shown in FIGS. 1 to 3 if desired.

Where the mattress pads of the present invention are used in an unheated location, such as in an automobile, a recreation vehicle or a truck in the winter time, the inner bladders may be filled with an antifreeze solution such as ethylene glycol or propylene glycol to prevent freezing.

I claim:

1. A flotation mattress pad for a bed comprising:

a rectangular inner bladder constructed from an impervious plastic material having a top side and a bottom side with coterminous peripheral edges, the top side having a valve, the inner bladder having a thickness between 2.5 and 10 centimeters;

a rectangular outer bladder constructed from a fluid impervious plastic material having a top side and a bottom side with coterminous peripheral edges, the outer bladder enclosing the inner bladder, the top side of the outer bladder having a circular opening positioned to surround the valve on the inner bladder and allow access thereto.

2. A mattress pad as claimed in 1 wherein the inner bladder has a width approximately half the width of the bed and further comprising a second similar half-wide, full length inner bladder, and wherein each inner bladder is covered by a separate outer bladder.

3. A mattress pad as claimed in 1 wherein the inner bladder is made from a colored material and the outer bladder is made from a transparent material.

4. A mattress pad as claimed in 3 wherein the outer bladder is made from a thinner material than the inner bladder.

5. A mattress pad as claimed in 4 and further comprising a heater located adjacent to the outer bladder bottom side.

6. A mattress pad as claimed in 4 adapted to fit on a bed by providing a space between the peripheral edges of the bed and the peripheral edges of the mattress pad when viewed in plan.

7. A mattress pad as claimed in claim 1, the mattress cover including an upper side constructed of mattress ticking having a thermal barrier layer; a bottom side; and peripheral sides made of a woven cloth fiber, said cover being provided with an elongate zippered opening to allow the insertion of outer and inner bladders and the filling thereof.

8. A mattress pad as claimed in claim 7 and further comprising straps attached to the mattress cover for securing same in place.

9. A mattress pad as claimed in claim 8 wherein said straps are in the form of elasticized outer straps extending between opposed peripheral edges of the mattress cover adjacent to said bottom side.

10. A flotation mattress pad for a bed comprising:

a rectangular inner bladder constructed form an impervious plastic material having a top side and a bottom side with coterminous peripheral edges, the top side having a valve;

a rectangular outer bladder constructed form a fluid impervious plastic material having a top side and a bottom side with coterminous peripheral edges, the outer bladder enclosing the inner bladder, the top side of the outer bladder having a circular opening positioned to surround the valve on the inner bladder and allow access thereto;

a mattress cover surrounding the outer and inner bladders, the mattress cover including an upper side constructed of mattress ticking having a thermal barrier layer, a bottom side, and peripheral sides made of a woven cloth fiber, said cover being provided with an elongate zippered opening to allow the insertion of outer and inner bladders and the filling thereof; and inner straps extending between opposed peripheral sides of the mattress cover above the outer bladder to hold the inner and outer bladders in place.

11. A mattress cover for a flotation mattress pad comprising: an upper side constructed of mattress ticking having a thermal barrier layer; a bottom side; peripheral sides made of a woven cloth fiber, said cover being provided with an elongate zippered opening to allow the insertion of a bladder and the filling thereof; and inner straps extending between opposed peripheral sides of the cover to hold the bladder in place.

12. A mattress cover as claimed in claim 11 wherein the thermal barrier layer includes a thin reflective plastic film attached to a felted sheet.

13. A mattress cover as claimed in claim 11 and further comprising straps attached to the mattress cover for securing same in place.

* * * * *

UNITED STATES PATENT AND TRADEMARK OFFICE

CERTIFICATE OF CORRECTION

PATENT NO. : 5,109,559

DATED : MAY 5, 1992

INVENTOR(S) : Gordon W. West

It is certified that error appears in the above-identified patent and that said Letters Patent is hereby corrected as shown below:

Column 4,

Claim 1, line 15, delete "and said opening having a peripheral edge unattached to the inner bladder to allow the valve to move below the outer bladder top side." and insert --a cover for the outer bladder having sections extending about said peripheral edges of the outer bladder; and straps joining spaced peripheral portions of the cover to retain the bladder within the cover.--

Column 2, line 63, "10" should be --12--.

Column 3, line 34, "pad 8" should be --pad 8.--

Signed and Sealed this

Third Day of August, 1993

*Attest:*

Michael K. Kirk

MICHAEL K. KIRK

*Attesting Officer*

*Acting Commissioner of Patents and Trademarks*